United States Patent [19]

Stevenson et al.

[11] 4,238,810

[45] Dec. 9, 1980

[54] FORCED COMMUTATION PRECIPITATOR CIRCUIT

[75] Inventors: Andrew C. Stevenson; Kenneth R. Fox, both of Peterborough, Canada

[73] Assignee: Canadian General Electric Company Limited, Toronto, Canada

[21] Appl. No.: 966,530

[22] Filed: Dec. 4, 1978

[30] Foreign Application Priority Data

Dec. 9, 1977 [CA] Canada ..... 292812

[51] Int. Cl.[3] ..... B03C 3/68

[52] U.S. Cl. ..... 361/91; 55/139; 361/235; 363/24

[58] Field of Search ..... 361/91, 235; 55/139; 363/24

[56] References Cited

U.S. PATENT DOCUMENTS

| | | | |
|---|---|---|---|
| 3,407,314 | 10/1968 | Wolff | 361/91 X |
| 3,622,839 | 11/1971 | Abrams et al. | 55/139 X |
| 3,877,896 | 4/1975 | Muskovac | 55/139 X |
| 4,051,425 | 9/1977 | Smith | 323/24 X |

*Primary Examiner*—Harry E. Moose, Jr.
*Attorney, Agent, or Firm*—Walter C. Bernkopf

[57] ABSTRACT

A control circuit for an electrical precipitator having a high voltage transformer with a bridge rectifier between the secondary of the transformer and the high voltage precipitator electrodes. The control circuit includes a pair of oppositely poled main thyristors in the primary circuit with a firing arrangement to trigger the main thyristors to maintain desired conditions at the electrodes. The primary circuit does not require a current limiting reactor to limit primary current when a spark discharge takes place at the electrodes. A pair of auxiliary thyristors are each connected in series with a capacitor. Each capacitor and the respective auxiliary thyristor form a branch and these two branches are each connected in parallel with the main thyristors. A rectifier is connected to keep the capacitors charged in opposing directions. When a spark discharge at the electrodes is detected, the firing circuit temporarily interrupts the firing pulses to the main thyristor which is conducting when the spark discharge occurs, and provides firing pulses to a respective auxiliary thyristor poled to conduct in the same direction. When the auxiliary thyristor is fired, the capacitor in series with it discharges through it and creates a voltage at the main thyristor which was conducting, and the voltage is such that the main thyristor switches to its non-conducting state before the end of the half cycle. The high primary current that could result with spark discharge is thus stopped before it reaches destructive levels.

7 Claims, 3 Drawing Figures

FORCED COMMUTATION PRECIPITATOR CIRCUIT

This invention relates to electrical precipitators, and in particular it relates to circuits for controlling an electrical precipitator.

An electrical precipitator is an apparatus which provides a relatively high DC voltage to electrodes positioned in a gas flow to ionize the gas to charge suspended particles and to create an electrostatic field and remove the charged suspended particles from the gas. Very generally a precipitator comprises a high voltage transformer with a control means connected between an AC power source and the primary of the transformer, and a bridge rectifier connected between the high voltage secondary winding of the transformer and the electrodes placed in the gas flow. The control means normally includes an inductive impedance in some form to limit the current flowing in the primary circuit when a short occurs in the secondary circuit, caused for example by a spark or series of sparks or an arc across the high voltage electrodes. This impedance protects the control as well as the transformer and rectifier against damage from the high currents that might otherwise exist.

There have been a number of forms or types of control means used in electrical precipitators. One type used a saturable reactor in series with the primary winding of the high voltage transformer. The reactor not only provided an inductive impedance to protect the primary circuit but the control winding on the reactor was connected to circuitry responsive to the high voltage at the electrodes to maintain a desired voltage level.

Another type of control means used thyristors as the control device. The thyristors were connected in series with a current limiting reactor and the primary winding. The thyristors, because of their fast and predictable response, could provide excellent control, and when a spark discharge occurred in the secondary circuit the thyristors were able to shut down the primary current flow after the half cycle in which the fault occurred, that is after one half cycle of fault current. Because in the absence of a reactor the fault current in that one half cycle might be, for example of the order of 20 times normal current, the current limiting reactor was required to be of a sufficient reactance to limit the current to a value which would not damage the control equipment nor the power system supplying the precipitator.

For maximum efficiency of a precipitator it is desirable to operate with a voltage on the electrodes or a current at the electrodes that is as high as possible without causing sparking or arcing. It is the present practice to control electrode current or electrode voltage depending on the type of control so that it increases very slowly until a spark discharge occurs or the current rating is reached. If a spark discharge occurs the current is then quickly reduced by a predetermined amount and the slow increase initiated once more. This maintains a high efficiency but often involves a slow controlled rate of sparking. While the current limiting reactor prevents any excessive current in the primary, it nevertheless has primary operating current passing through it which results in a power loss and generates heat. The heat must, of course, be dissipated and this could be a problem in large multiple installations. Thus, the current limiting reactor is expensive, must be mounted where no conducting material is in the immediate vicinity because of the considerable magnetic field it creates, and it generates heat which must be dissipated.

It is a feature of the present invention to provide a control system which does not require a current limiting reactor in series with the primary winding of the high voltage transformer of a precipitator.

The present invention provides a pair of main thyristors to control the primary current flow as in the prior art, but the only reactance in the primary circuit is that provided by the leakage reactance of the transformer. No separate reactor is required. Two oppositely poled capacitors are provided each having a control thyristor or auxiliary thyristor in series with it. Means is provided to maintain a charge on each capacitor. In the event of a spark discharge occurring in a particular half cycle, a respective one of the auxiliary or control thyristors is triggered to a conducting condition permitting the capacitor in series with it to discharge. The circuit is arranged so that the discharge of the capacitor provides a voltage to cut off the main thyristor which was conducting when the spark discharge occurred; that is, it forces commutation prior to the end of the half cycle of conduction when that thyristor would in any case be turned off. As the thyristors respond quickly, there is no need for the addition of a current limiting reactor in series in the primary circuit.

Therefore, in accordance with one form of the invention there is provided a control circuit for an electrical precipitator having a high voltage transformer with a primary and a secondary winding, said secondary winding being connected through rectifier means to high voltage precipitator electrodes, said control circuit comprising main thyristor means for connection between a source of alternating electrical power and said primary winding and being responsive to firing pulses for controlling power to said electrodes, capacitor means for storing an electrical charge, auxiliary thyristor means connected with said capacitor means in parallel with said main thyristor means, said auxiliary capacitor means being responsive to firing pulses to switch to a conductive state and discharge said capacitor means, and firing circuit means for providing firing pulses to said main thyristor means for controlling said power to said electrodes and being responsive to a spark discharge at said electrodes for temporarily interrupting firing pulses to said main thyristor means and providing firing pulses to said auxiliary thyristor means to discharge said capacitor means to cause said main thyristor means to switch to a non-conductive state before the end of the half cycle in which spark discharge occurs.

The invention will be described in more detail with reference to the accompanying drawings, in which.

Figure 1:
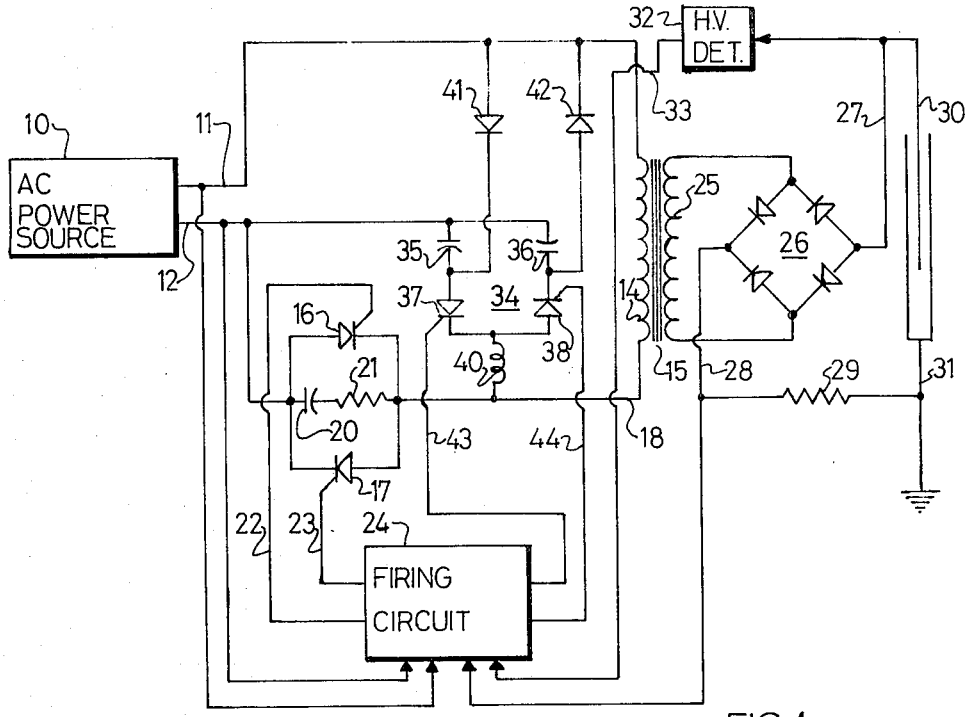
FIG. 1 is a simplified circuit diagram of a precipitator in accordance with one form of the invention.

Referring to FIG. 1, the precipitator circuit is connected to an AC power source 10 which provides operating power to the precipitator, by conductors 11 and 12. Conductor 11 is connected to one side of primary winding 14 of high voltage transformer 15. Conductor 12 is connected to a parallel arrangement of oppositely poled main thyristors 16 and 17, and conductor 18 connects this parallel arrangement of thyristors 16 and 17 to the other side of primary winding 14. This is basically the primary circuit of the precipitator where primary winding 14 and a control means comprising thyristors 16 and 17 are connected in series to the AC power source. The series connected capacitor 20 and resistance 21 form a snubber which controls the rate of rise of voltage across thyristors 16 and 17 when they are switched off or when there is a disturbance in the AC power source that might cause a rapid increase in voltage across thyristors 16 and 17. The thyristors 16 and 17 are switched on by control signals or firing signals on conductors 22 and 23 respectively, from a firing circuit 24. Once a thyristor fires it continues in its conductive state until the end of the half cycle in which it is fired, that is until the voltage reverses. The point at which thyristors 16 and 17 are fired thus controls the current in primary winding 14 of transformer 15 and thus the level of the voltage that will appear across secondary winding 25 and the current in the secondary circuit. A bridge rectifier 26 provides a high DC voltage on conductors 27 and 28 and thus across electrodes 30 and 31. A small resistance 29 between conductor 28 and electrode 131 is used to obtain a signal on conductor 28 which varies with the current flow to the electrodes. Conductor 28 is connected to firing circuit 24 to provide thereto a signal representative of current flow in the precipitator electrode system. A high voltage detector 32 is connected to conductor 27 and it provides on conductor 33 a signal representing the electrode voltage. Conductor 33 is connected to firing circuit 24 to provide thereto a signal representative of voltage in the precipitator electrode system. Conductors 11 and 12, which are connected to the AC power source 10 are also connected to firing circuit 24 to provide reference signals for use in firing or switching the thyristors.

Connected between conductors 12 and 18 is a circuit 34 which includes capacitors 35 and 36 auxiliary thyristors 37 and 38. The capacitor 35 and thyristor 37 form one branch, the capacitor 36 and thyristor 38 form the other branch. The two branches are in parallel with one another and are connected to conductor 18 by a reactor 40. It should be noted that reactor 40 is not in the primary circuit, that is, it is not in series with winding 14. Reactor 40 has a relatively low reactance and conducts current only when one of the thyristors 37 or 38 is switched on. Reactor 40 will limit the rate of rise of current to prevent damage to thyristors 37 and 38. Diodes 41 and 42 are connected respectively between the junction of capacitor 35 and thyristor 37 and between the junction of capacitor 36 and thyristor 38 and conductor 11 to charge the respective capacitors on alternate half cycles of the power source.

While the operation of the precipitator of FIG. 1 will be described in more detail hereinafter, briefly, when a spark discharge is detected by the signals applied to firing circuit 24 over conductors 28 and 33, the normal triggering signals applied to thyristor 16 or 17 are interrupted and the appropriate one of thyristors 37 or 38 is triggered. For example, if thyristor 16 is conducting when a spark discharge is detected, any firing pulses to thyristor 16 via conductor 22 will be interrupted and thyristor 37 will be triggered or switched on by a signal on conductor 43. Capacitor 35 will discharge through thyristor 37 and reactor 40 and in effect cancel the load current flowing through thyristor 16, altering the voltage and turning thyristor 16 off. The capacitor 35 must, of course, have sufficient capacitor to do this. Thus thyristor 16 is forced to switch off rapidly and before the end of the half cycle when it would normally switch off in any case. Simarily, if thyristor 17 is conducting when the spark, discharge is detected, then further firing pulses to thyristor 17 are terminated and thyristor 38 is switched on by a signal on conductor 44. Thus the fault current in the primary circuit is stopped relatively quickly.

Figure 2:
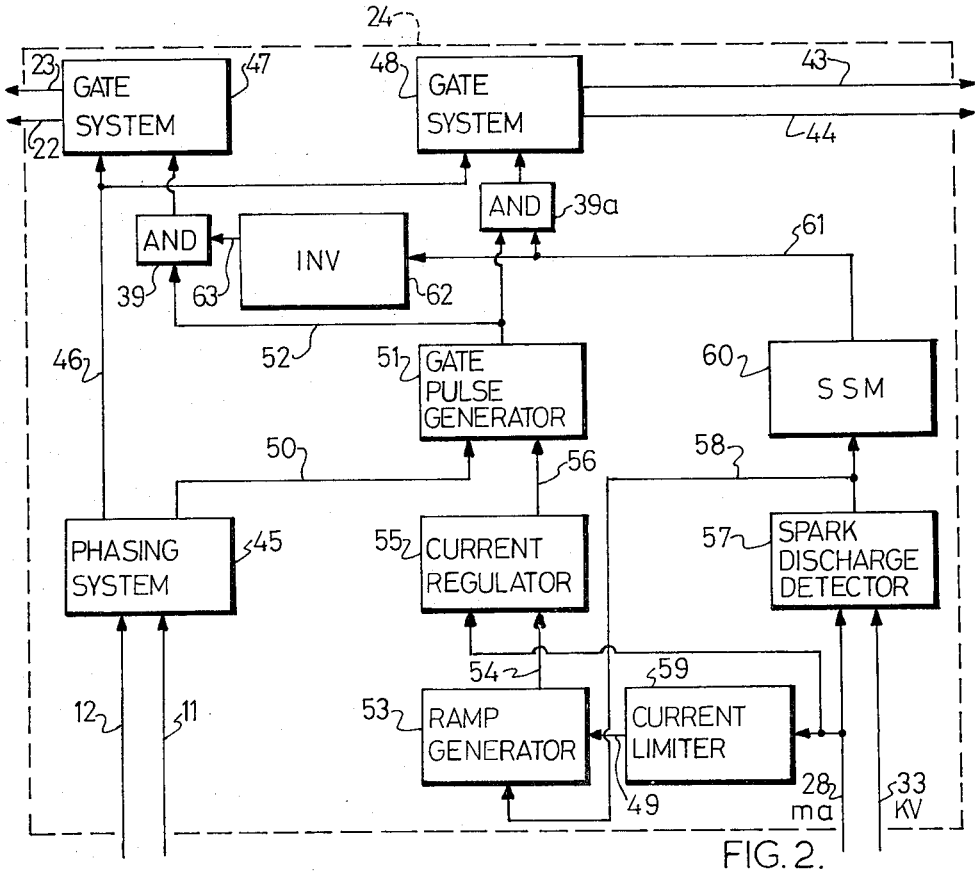
FIG. 2 is a simplified block circuit diagram of the firing circuit of FIG. 1.

Referring now to FIG. 2, which is a simplified block diagram of a circuit suitable as firing circuit 24 of FIG. 1, there are inputs on conductors 11 and 12 representing the AC power source voltage, and inputs on conductors 28 and 33 representing electrode current and voltage respectively. The conductors 11 and 12 are connected to a phasing system 45. It is necessary to have a reference for the firing of the main thyristors 16 and 17 (FIG. 1) so that the appropriate thyristor will be fired for each half cycle of the power source and will be fired at a desired time in that half cycle. Phasing system 45 therefore provides a signal on conductor 46 which is applied to both gate system 47 and 48. This signal conditions the gate system 47 so that it will provide an output on conductor 22 only in that half cycle when thyristor 16 can conduct, and only on conductor 23 in the other half cycle when thyristor 17 can conduct. Similarly the signal on conductor 46 conditions gate system 48 so that it will provide an output on conductor 43 only in the half cycle in which thyristor 16 can conduct, and so that it will provide an output on conductor 44 only in that half cycle in which thyristor 17 can conduct. Phasing system 45 also provides a signal on conductor 50 to gate pulse generator 51. The signal on conductor 50 is a reference signal representing a predetermined instant in the power signal, such as for example to zero crossing, so that the pulse generator 51 can initiate firing pulses during normal operation with a certain variable time delay after the reference. These firing pulses are on conductor 52 and are applied to AND gates 39 and **39*a***.

It is known, and it was previously mentioned, that for improved efficiency of the electrode current may be slowly increased until spark discharge is detected and then the current quickly decreased and the cycle repeated. The cycle may, for example, be between one minute and ten minutes although any cycle length may be used as circumstances require. The circuit of FIG. 2 includes means for effecting such a cycling. A ramp generator 53 provides a slowly increasing signal at 54 which is applied to current regulator 55. Conductor 28 is also connected to regulator 55 to provide thereto a signal representing precipitator electrode current. Current regulator 55 compares these two signals and provides on conductor 56 a control signal which is applied to gate pulse generator 51 to control the time during each cycle at which firing pulses are provided to fire the main thyristors.

A spark discharge detector 57 receives on conductors 28 and 33 signals representing respectively current and voltage at the high voltage electrodes. From these signals it determines the occurrence of a spark discharge and provides a signal on conductor 58 indicating spark discharge. Conductor 58 applies this signal to ramp generator 53 causing it to step back or decrease its output by a predetermined amount and then commence a slow increase. Conductor 58 is also connected to current regulator 55 and a signal on conductor 58 indicating occurrence of a sprak discharge will cause current regulator 55 to provide a signal on conductor 56 inhibiting gate pulse generator 51 from providing firing signals during the next succeeding half cycle, or two or more half-cycles if required, following the half cycle in which spark discharge takes place to permit the circuitry to recover.

Conductor 58 is also connected to a single shot multivibrator (i.e., SSM) circuit 60. The multivibrator 60 normally provides a signal on conductor 61 to AND gate 39*a* which maintains the gate closed. This signal is inverted by inverter 62 so that the signal on conductor 63 is an enabling signal. When a spark discharge is detected, the signal on conductor 58 triggers the single shot multivibrator and it provides a signal on conductor 61 which enables AND gate 39*a* and at the same time via inverter 62 provides a signal on conductor 63 closing AND gate 39. The conductor 52 carries firing pulses which are passed by whichever of the AND gates 39 and 39*a* is enabled to the respective gate system 47 or 48. Thus the firing pulses are switched from whichever thyristor 16 or 17 (FIG. 1) is conducting to the respective thyristor 37 or 38 (FIG. 1). The single shot multivibrator 60 is designed to return to its normal state in the following half cycle and in any case before firing pulses are again provided by pulse generator 51. It will be recalled that current regulator 55 is responsive to the spark discharge signal on conductor 58 to inhibit firing pulses from pulse generator 51 beginning with the half cycle following a spark discharge and lasting for at least that half cycle. By the time pulse generator 51 is again providing firing pulses, the multivibrator will have reset and the firing pulses will be directed through gate system 47 to the appropriate one of main thyristor 16, 17.

A current limiter 59 is provided to limit a further increase in the ramp generator signal should the current increase to the rating of the transformer without a spark discharge. Without a spark discharge, the ramp generator would not step back and would otherwise continue to increase resulting in a continuing increase in output causing an overload condition. Current limiter 59 senses the signal on conductor 28, representing electrode current and applies a signal to ramp generator 53 over conductor 49 if a predetermined current is exceeded, and this limits the ramp generator output.

Figure 3:
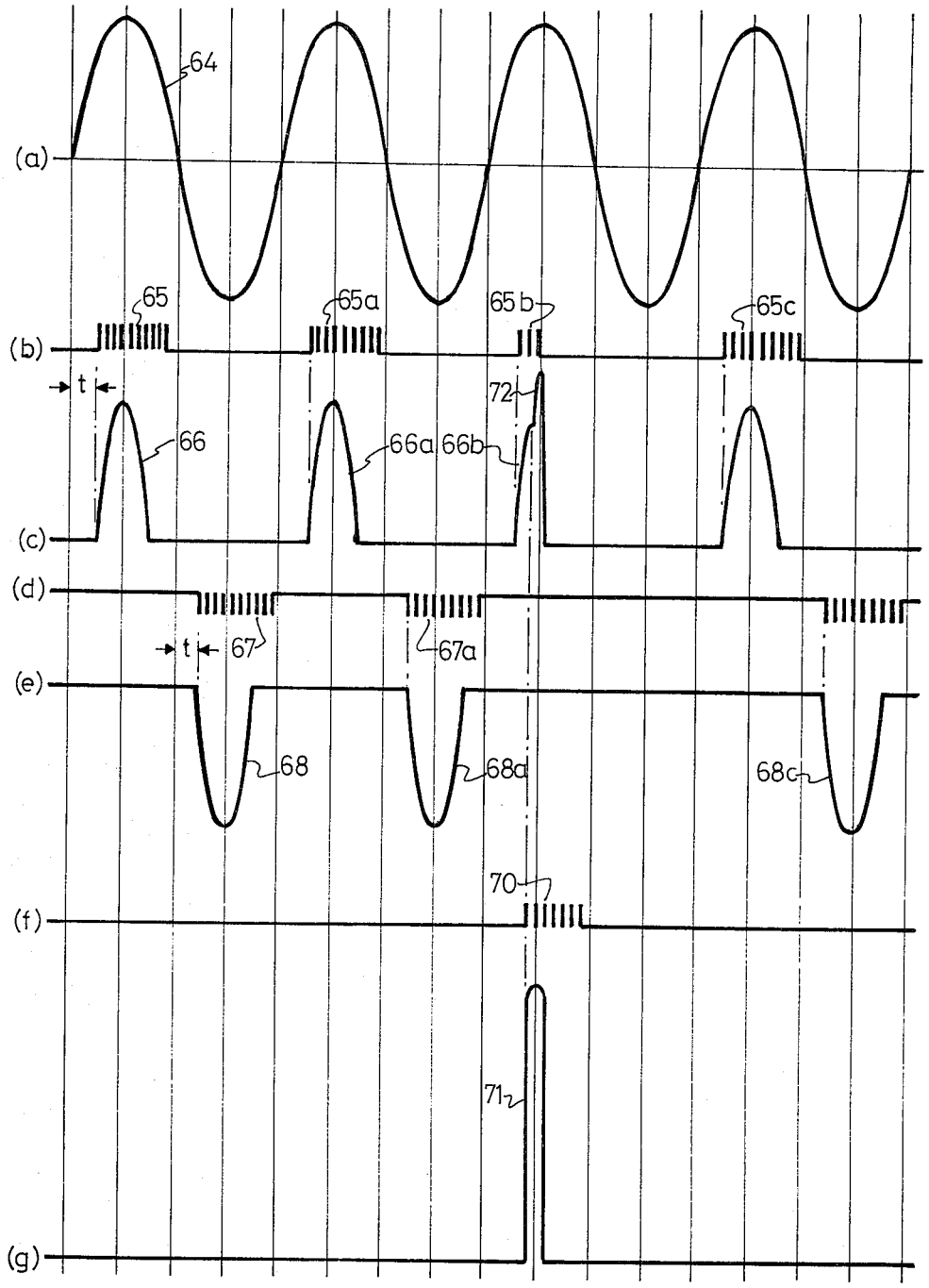
FIG. 3 is a waveform diagram useful in explaining the operation of the invention.

Referring now to FIG. 3 in conjunction with FIGS. 1 and 2, the operation of portions of the circuit will be explained in more detail. FIG. 3 (*a*) shows a waveform 64 representative of the voltage of the AC power source 10 plotted against time. FIG. 3 (*b*) shows firing pulses 65, 65*a*, 65*b*, etc. which would be applied via conductor 22 to trigger thyristor 16. These pulses 65 are initiated at time t after the beginning of a positive (as shown) half cycle. The time t is variable and controlled by current regulator 55 via pulse generator 51 to provide an appropriate period of conduction to give a desired current at the electrodes as was previously explained. The pulses 65 are shown in normal operation as continuing until just before the end of a half cycle. It will be apparent that it is not necessary to continue the firing pulses for so long and it is done only as a design convenience.

FIG. 3 (*c*) shows current pulses 66, 66*a*, which flow through thyristor 16 in response to the respective trigger pulse 65, 65*a*.

FIG. 3 (*d*) shows firing pulses 67, 67*a*, etc. which would be applied via conductor 23 to trigger thyristor 17. These pulses are initiated at a time t after the beginning of a negative (as shown) half cycle. The time t is, of course, controlled by the firing circuit 24 to control the primary current. FIG. 3 (*e*) shows current pulses 68, 68*a* which flow through thyristor 17 in response to respective trigger pulse 67, 67*a*.

FIG. 3 (*f*) shows a firing pulse 70 which would be applied via conductor 43 to trigger thyristor 37 when a spark discharge occurs while thyristor 16 is conducting. FIG. 3 (*g*) shows a current pulse 71 typical of current flow through thyristor 37 when it is fired.

The firing pulses 65*b* of FIG. 3 (*b*) begin as normal and the current flow through thyristor 16 as represented by 66*b* of FIG. 3 (*c*) begins as a normal pulse. However, part way through the conduction cycle for thyristor 16 we assume a spark discharge occurs at the precipitator electrodes. This may be considered as an effective short circuit for the primary and the current through thyristor 16 begins to rise quickly as represented by the spike 72. However, the spark discharge is detected by detector 57 and the multivibrator 60 is triggered. This closes gate system 47 and enables gate system 48 which switches firing pulses from thyristor 16 to thyristor 37. The pulses applied to thyristor 37 (pulses 70 of FIG. 3 (*f*)) permit capacitor 35 to discharge through thyristor 37 (current pulse 71 of FIG. 3 (*g*)) which causes thyristor 16 to switch to its nonconductive state. The ramp generator 53 is stepped back and current regulator 55 signals pulse generator 51 to refrain from generating firing pulses for at least one half cycle. This accounts for the missing firing pulses in FIG. 3 (*d*) and the respective missing current pulse (between 68*a* and 68*c*) in FIG. 3 (*e*). The multivibrator 60 returns to its normal condition and firing pulses for the succeeding half cycle, that is firing pulses 65*c*, continue in the normal manner.

It is believed the operation of the circuitry of the invention will now be clear. Various alternate forms of controlling the electrode voltage are known in the art and may be used with the spark responsive circuit according to the present invention.

What we claim as new and desire to secure by Letters Patent of the United States is:

1. A control circuit for an electrical precipitator, comprising main thyristor means for controlling power from an AC source to the electrodes of said precipitator, capacitor means, auxiliary thyristor means for controlling the discharge of an electrical charge stored in a said capacitor means, means responsive to a spark discharge at the electrodes of the precipitator to temporarily place said main thyristor means in a state where it would become non-conductive at the end of the half cycle in which spark discharge occurs and to cause said auxiliary thyristor means to discharge said capacitor means to provide a voltage at said main thyristor means rendering it non-conductive before the end of the half cycle in which spark discharge occurs.

2. A control circuit for an electrical precipitator having a high voltage transformer with a primary and a secondary winding, said secondary winding being connected through rectifier means to high voltage precipitator electrodes, said control circuit comprising main thyristor means for connection between a source of alternating electrical power and said primary winding and being responsive to firing pulses for controlling power to said electrodes, capacitor means for storing an electrical charge, auxiliary thyristor means connected with said capacitor means in parallel with said main thyristor means, said auxiliary capacitor means being responsive to firing pulses to switch to a conductive state and discharge said capacitor means, and firing circuit means for providing firing pulses to said main thyristor means for controlling said power to said electrodes and being responsive to a spark discharge at said electrodes for temporarily interrupting firing pulses to said main thyristor means and providing firing pulses to said auxiliary thyristor means to discharge said capacitor means to cause said main thyristor means to switch to a non-conductive state before the end of the half cycle in which spark discharge occurs.

3. A control circuit as defined in claim 2 in which said main thyristor means comprises a pair of main thyristors connected in an oppositely poled parallel arrangement for controlling power on positive and negative half cycles of alternating power.

4. A control circuit as defined in claim 3 in which said capacitor means comprises two capacitors and in which said auxiliary thyristor means comprises two auxiliary thyristors, a said capacitor and a said auxiliary thyristor being in series to form a branch of a two branch parallel circuit arrangement, the branches having an oppositely poled configuration, said firing circuit providing firing pulses responsive to said spark discharge to the one of said auxiliary thyristor means poled to conduct in the same direction as the main thyristor which was conducting when spark discharge occurred.

5. A control circuit as defined in claim 4 and further comprising a reactor in series with said two branch parallel circuit arrangement for limiting rate of current rise in the two branch parallel circuit arrangement when it switches from a conducting to a non-conducting condition.

6. A control circuit for an electrical precipitator having a high voltage transformer with a primary and a secondary winding, said secondary winding being connected through rectifier means to high voltage precipitator electrodes, said control circuit comprising first and second main thyristors connected in an oppositely poled parallel arrangement between a source of alternating power and said primary winding, first and second auxiliary thyristors and first and second capacitors, said first auxiliary thyristor and first capacitor being in series and said second auxiliary thyristor and second capacitor being in series, each auxiliary thyristor and capacitor forming an oppositely poled branch of a parallel circuit arrangement, means connecting said parallel circuit arrangement in parallel with said parallel arrangement of said first and second main thyristors, rectifier means for charging each said capacitor, firing circuit means for applying to the control electrode of each said first and second main thyristor firing pulses to switch on a respective one of said first and second main thyristors during the half cycle of alternating power in which it is poled to conduct, spark discharge detector means for detecting spark discharge at said high voltage electrodes and applying to said firing circuit means a signal representing spark detection, said firing circuit means being responsive to said signal to temporarily prevent firing pulses being applied to at least the conducting one of said first and second main thyristor and to apply firing pulses to the control electrode of a respective one of said first and second auxiliary thyristors to switch it to its conducting state and permit discharge of the one of said first and second capacitors in series therewith to cause said conducting one of said first and second main thyristors to change to its non-conducting state.

7. A control circuit as defined in claim 6 in which said firing circuit means includes a delay means which in response to said signal representing spark detection prevents firing pulses being applied to said first and second main thyristors for the remainder of the half cycle in which spark discharge occurs and for the following half cycle.

* * * * *